US005137503A

United States Patent [19]

Yeh

[11] Patent Number: 5,137,503

[45] Date of Patent: Aug. 11, 1992

[54] EXERCISE HAND GRIP HAVING SOUND-REPRODUCING MEANS AND APPLICATION OF SUCH HAND GRIP

[76] Inventor: Peter Yeh, 6th Fl., No. 210, An Ho Rd., Taipei, Taiwan

[21] Appl. No.: 765,726

[22] Filed: Sep. 26, 1991

[51] Int. Cl.[5] ..... A63B 21/02

[52] U.S. Cl. ..... 482/125; 482/126; 482/139

[58] Field of Search ..... 482/121, 122, 124, 125, 482/126, 139, 82

[56] References Cited

U.S. PATENT DOCUMENTS

| | | | |
|---|---|---|---|
| 3,049,961 | 8/1962 | Decker | 482/82 |
| 3,778,053 | 12/1973 | Smith, III et al. | 482/82 |
| 4,090,705 | 5/1978 | Young | 482/82 |
| 4,195,835 | 4/1980 | Hinds et al. | 482/126 |
| 4,489,938 | 12/1984 | Darzinskis | 482/125 |
| 4,736,946 | 4/1988 | Gordon | 482/125 |
| 4,976,427 | 12/1990 | Patucek | 482/126 |

*Primary Examiner*—Richard J. Apley
*Assistant Examiner*—Lynne Reichard
*Attorney, Agent, or Firm*—Browdy and Neimark

[57] ABSTRACT

An exercise hand grip having sound-reproducing means and application of such hand grip comprises mainly two handles and one connection rod. One of the handles comprises a first housing and a second housing, both of which are of hollow constructions made of plastic material by means of injection molding. The first housing is provided therein with a speaker mount with a circular speaker disposed thereon, a sound-reproducing apparatus provided therein with conductive pieces disposed in the battery mount, and a circuit plate in contact with batteries lodged in the battery mount. The circuit plate comprises thereon an integrated circuit storing programmably musical melodies or commands. The second housing is symmetrical in shape with the first housing. Another handle is provided with a third housing and a fourth housing, both of which are of hollow constructions made of plastic material by means of injection molding. The third housing is provided therein with an exercise count display apparatus. The connection rod is of a bendable spring body coupled pivotally at both ends thereof with both handles.

4 Claims, 4 Drawing Sheets

EXERCISE HAND GRIP HAVING SOUND-REPRODUCING MEANS AND APPLICATION OF SUCH HAND GRIP

BACKGROUND OF THE INVENTION

The present invention relates to a sports and recreational device, and more particularly to an exercise hand grip having sound-reproducing means disposed therein and to the application of such hand grip.

The exercise hand grip referred to in the present invention is similar to those short bars usually used in pairs in a body building device consisting of an elongated elastic body joined by two short bars, by which the elastic body is repeatedly bent by user's hands for muscular exercise.

The sports and recreational activities have become important parts of daily life of people, especially youngsters and children who become bored easily by a monotonous exercise. The exercise device mentioned above is generally used in coordination with sports music and the like; therefore it must be accompanied by a separate sound reproducing equipment. For this reason, it is quite inconvenient to people for using such sports device in outdoor game. If such sports device is used for a competitive purpose or a self testing, the exercise counts would have to be done by people who are prone to make mistake and are thus unreliable.

SUMMARY OF THE INVENTION

It is therefore the primary objective of the present invention to provide exercise hand grips having a built-in sound-reproducing means capable of reproducing musical melodies, sports music and command so as to afford dual purposes of exercise and recreation.

It is another objective of the present invention to provide hand grip and application of such hand grip with means capable of making accurate exercise counts, which are readily displayed on the hand grip.

In keeping with the principles of the present invention, the primary objectives of the present invention are accomplished by an exercise hand grip, which comprises mainly two handles, a sound-reproducing apparatus, and a spring body. The first handle is made up of a first housing of a hollow rod-shaped construction made of plastic material by means of injection molding. The first housing is at least provided therein with a battery mount and a speaker mount. The first handle is further composed of a second housing, which is a hollow body made of plastic material by means of injection molding and is corresponding in shape to the first housing. The second handle is made up of a third housing and a fourth housing, both being hollow bodies made of plastic material. The second handle comprises therein a count display apparatus. The sound-reproducing apparatus comprises a plurality of conductive pieces arranged in the battery mount of the first housing of the first handle and further comprises a speaker secured to the speaker mount of the first housing of the first handle. The spring body of a rod-shaped construction is used as a connecting means with both ends thereof being respectively coupled with both handles. The spring body can be bent back and forth by means of handles for muscular exercise.

The features, objectives, and advantages of the present invention can be better understood by studying the following detailed description of the preferred embodiment, in conjunction with the drawings provided herein.

DETAILED DESCRIPTION OF THE PREFERRED EMBODIMENTS

Figure 1:
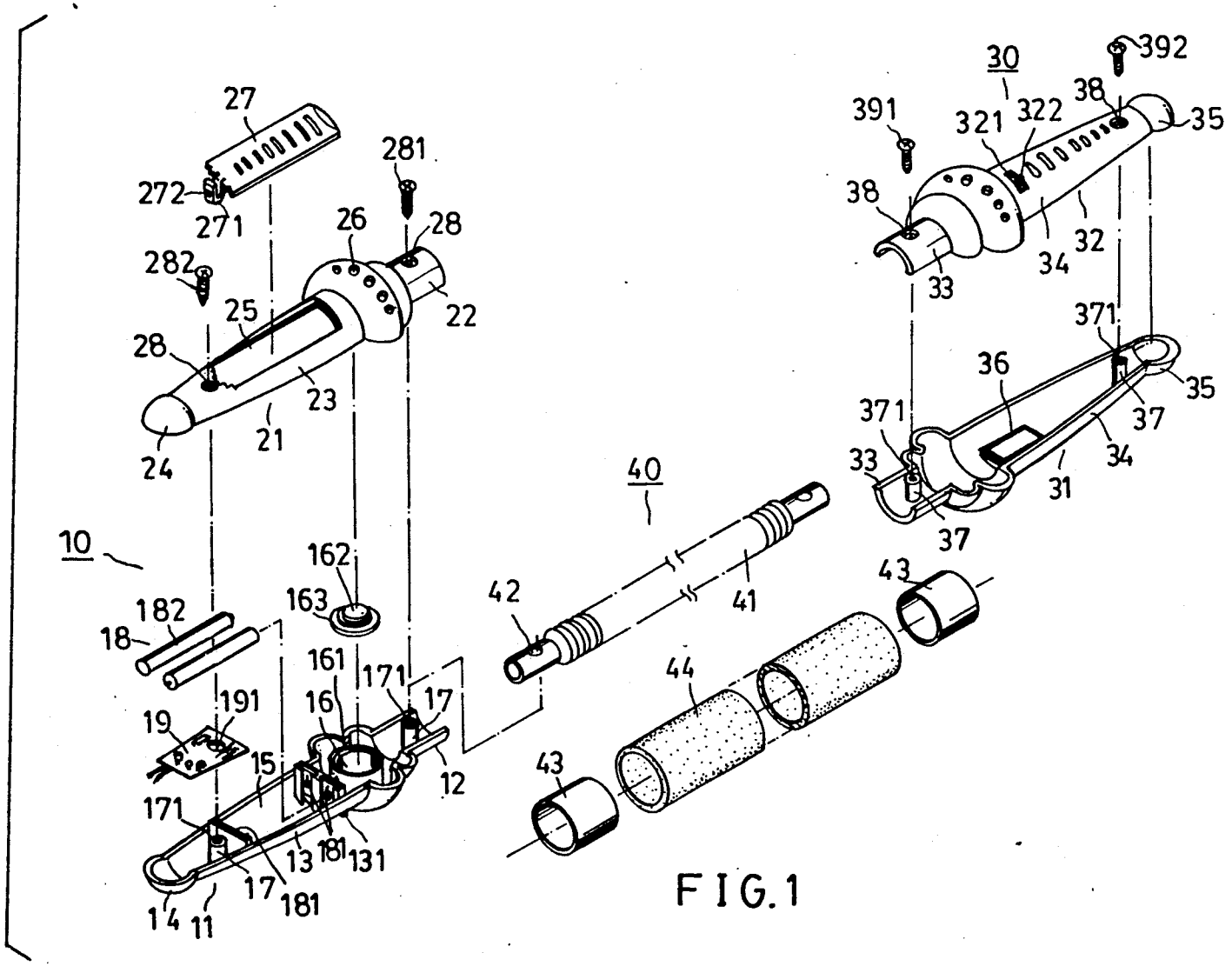
FIG. 1 shows an exploded view of hand grip embodied in the present invention.
Figure 2:
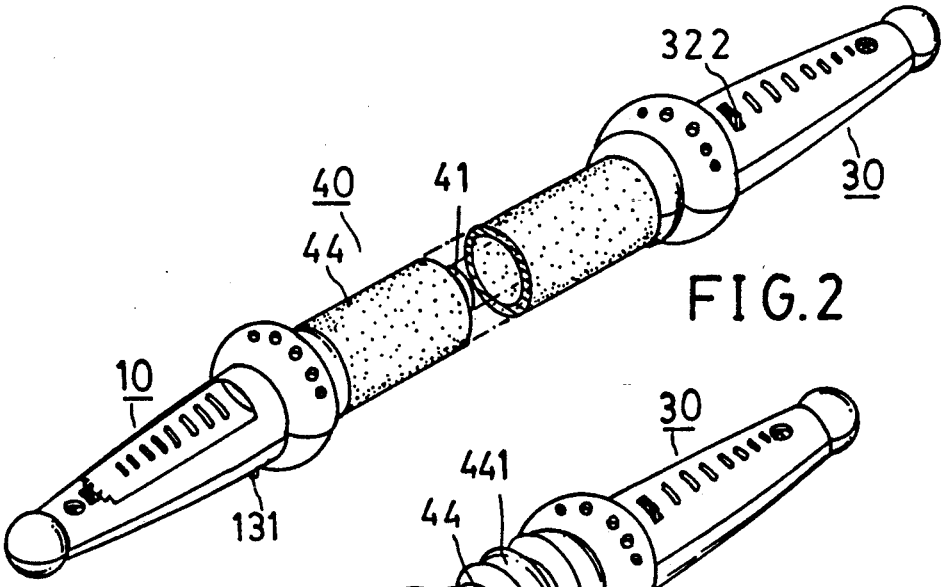
FIG. 2 shows an external three-dimensional view of an assembled hand grip as shown in FIG. 1.

Referring to FIGS. 1 and 2, the hand grip embodied in the present invention is shown comprising two handles 10 and 30 and a connection member 40.

The first handle 10 is composed of a first housing 11 of a hollow construction made of plastic material by means of injection molding. The first housing 11 is provided mainly with a connection portion 12, a central handle portion 13, and a round tail 14. The central handle portion 13 comprises a switch hole (not shown in the drawings) intended to secure thereinto a switch 131. The first housing 11 is of a hollow construction having an external surface of a circular arc shape and is provided therein with a battery and a speaker 162 having a disc portion 163 to fit into the circular edge 161 of the speaker mount 16. Erected in the first housing 11 are two lock columns 17 having a screw hole 171 disposed at the top end thereof. The sound reproducing apparatus 18 consists of several conductive pieces 181 secured to the battery mount 15. The batteries 182 are lodged between conductive pieces 181 in the battery mount 15. The circuit plate 19 is provided thereon with a sound-reproducing control circuits, which will be expounded further later in this specification, and a circular hole 191. The second housing 21 is also of a hollow construction made of plastic material by means of injection molding and is corresponding in shape to the first housing 11. The second housing 21 is made up of a connection portion 22, a central handle portion 23, and a round tail 24. The handle portion 23 is provided with a battery cover hole 25 and a predetermined number of sound holes 26 communicating with the speaker 162. The battery cover 27 made of plastic material by means of injection molding comprises at one end thereof a U-shaped lock spring 271 having at one end thereof a snap-in point 272 for securing the battery cover 27 to the battery cover hole 25. The second housing 21 further comprises two screw holes 28 permitting two screws 281 and 282 to pass therethrough to engage with two screw holes 171 of the first housing 11.

The second handle 30 is composed of a third housing 31 and a fourth housing 32 and is of a hollow construction made of plastic material by means of injection molding. Both third housing 31 and fourth housing 32 are respectively provided with a connection portion 33, a central handle portion 34, and a round tail 35. The third housing 31 further comprises therein a count display apparatus 36 connected with the circuit plate 19 and two screw holes 38 permitting two screws 391 and 392 to pass therethrough to engage with the screw holes 371 of the third housing 31.

The connection member 40 has a connection rod 41, which is a bendable elastic body with the diameters of both ends thereof being slightly smaller than the inner diameters of the connection portions 12 and 33 of the handles 10 and 30. Both ends of the connection rod 41 are provided with through holes 42 and metal ring sleeves 43 having inner diameters greater than the outer diameters of connection portions 12 and 33 so as to permit the connection portions 12 and 33 to fit into the ring sleeves 43, which are in turn fitted into protective sleeves 44 intended to mitigate the shock resulted from the bending of the connection rod 41 for minimizing the possibility of body injury to the user of the hand grip.

Figure 5:
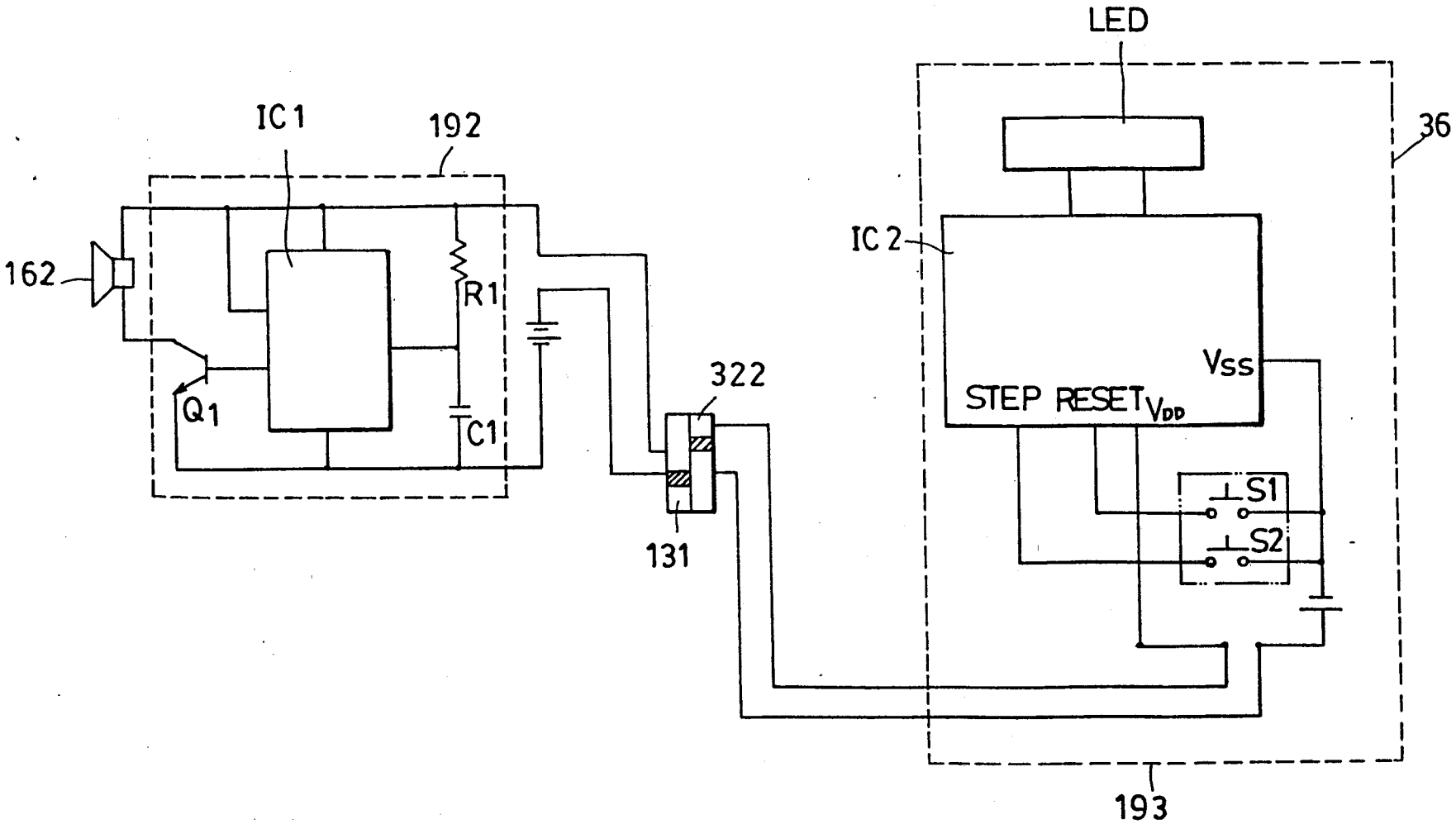
FIG. 5 shows a circuitry of sound-reproducing apparatus and count display apparatus embodied in the present invention.

As shown in FIG. 5, the circuitry of the circuit plate 19 and the count display apparatus 36 consists of a sound reproducing control circuit 192 and a count control circuit 193. The musical melodies, sports music and commands are all programmably stored in the integrated circuit IC1. Therefore, as soon as the switch 131 is turned on, the integrated circuit IC1 reproduces, in conjunction with resistance R1, capacitance C1, and transistor Q1, the stored melodies, sports music and commands via the speaker 162. The count display apparatus 36 is provided with an integrated circuit IC2, which is the count control IC whose counting results are displayed via a digital LED. As soon as the switch S1 is pressed, the digit on the LED will reset. The switch S2 is connected once when each exercise motion of the hand grip is completed. In other words, the completion of one ON-OFF cycle is registered accordingly as one count in the integrated circuit IC2. The switch S2 can be either a contact type or a mercury type. As soon as the count switch 322 has been turned on, the count display apparatus 36 is triggered. The count control circuit used in the present invention is similar to a commonly used conventional circuit.

The hand grip having sound reproducing means described above can be assembled by permitting the through holes 42 of the connection rod 41 to be arranged on the lock columns 17 of the first housing 11 and subsequently by placing all the components of the first housing 11 on their respectively designated positions. Thereafter, the second housing 21 is placed on the first housing 11 in such manners that the screw 281 is permitted to pass through the screw hole 28 so as to engage with the screw hole 171 of the lock column 17, and that the screw 282 is allowed to pass through the screw hole 28 and the circular hole 191 of the circuit plate 19 so as to engage with the screw hole 171 of the lock column 17. The ring sleeve 43 is fitted around the connection portions 12 and 22 for reinforcing the connection portions 12 and 22 for reinforcing the connecting strength so as to prevent the screw 281 from loosening when the hand grip is bent. The protective sleeve 44 is fitted over the ring sleeve 43 as a shock absorber to protect the user of the hand grip from body injury resulted therefrom. The process of assembling the third housing 31 and the fourth housing 32 begins with fitting another ring sleeve 43 around the connection rod 41. Thereafter, the third and the fourth housings 31 and 32 can be joined together by following the procedures described above for assembling the first and the second housings 11 and 21. As a result, an exercise hand grip, as shown in FIG. 2, is made.

Figure 3:
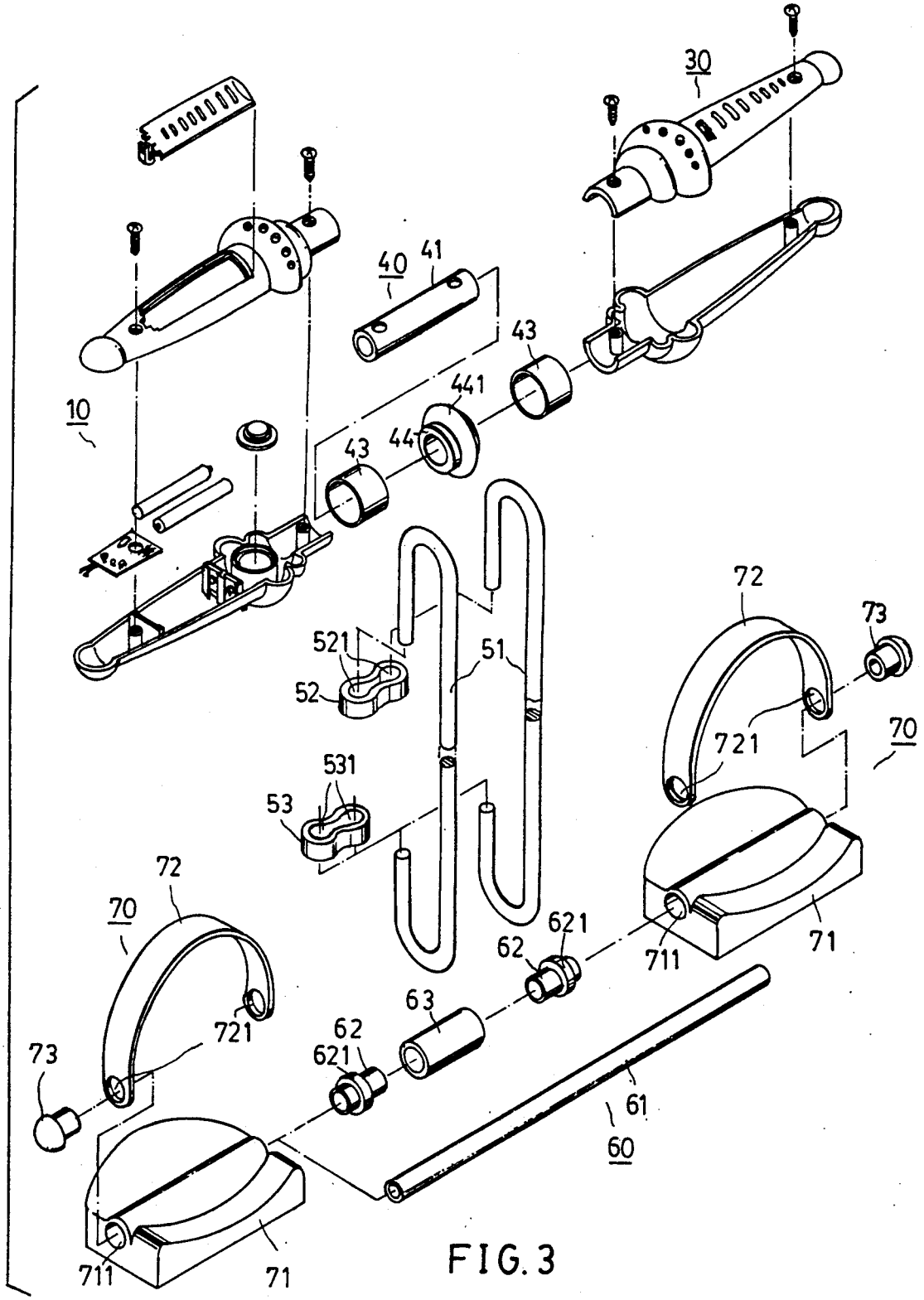
FIG. 3 shows an exploded view of a leg press machine employing another embodiment of the present invention.

As shown in FIG. 3, an application of another embodiment of the present invention is illustrated. The connection rod 41 can be replaced by a sleeve made of hard material while the protective sleeve 44 can be supplanted by a hollow tube, which is made of rigid material and is composed of a center ring 441 disposed at the center thereof. The inner diameter of the protective sleeve 44 should be slightly greater than the outer diameter of the connection rod 41 so that the former can fit around the latter. The length of the protective sleeve 44 is relatively short so as to permit the connection member 41 to be arranged in such a way that there remains an appropriate clearance between the protective sleeve 44 and each of the two ring sleeves 43. Two cane-like elastic bodies 51 are made of foamed material. Two fastening rings 52 and 53 are respectively provided with two fastening holes 521 and 531 which are designed to fit around the elastic bodies 51 in such a manner that both upper and lower ends of the elastic bodies 51 are constructed as ferrules to give an added strength. A fitting rod set 60 is provided with a rigid fitting rod 61, two spacers 62, and a protective sleeve 63. The fitting rod 61 is fitted into the two spacers 62 having thereon a protruded shoulder 621. The protective sleeve 63 is fitted around two spacers 62 in such a manner that its both ends press against the protruded shoulders 621. Each of the two step sets 70 is provided with a rectangular step 71 with a through hole disposed along the horizontal axis thereof, a U-shaped foot casing 72 having at both ends thereof circular holes 721, and a combination column 73 capable of passing through the circular hole of the foot casing 72 to fit into the through hole 711 of the step 71.

In the process of assembling the hand grip and its subsidiary structures described above, two fastening rings 52 and 53 are first fastened to the cane-like elastic bodies 51, with one end of the elastic body 51 being fitted into the interspace formed by the protective sleeve 44 and the ring sleeve 43 and the other end of the elastic body 51 being fitted on the fitting rod set 60. The fitting rod 61 is inserted into one end of the through hole 711 via the circular hole 721 of the foot casing 72 so as to permit the protruded shoulder 621 of the spacer 62 to press securely against the inner end of the step 71. The combination column 73 is then placed through the circular hole 721 of the foot casing 72 to press against the outer end of the through hole 711 in order to complete the construction of an exercise device employing the hand grip of the present invention, as shown in FIG. 4.

Figure 4:
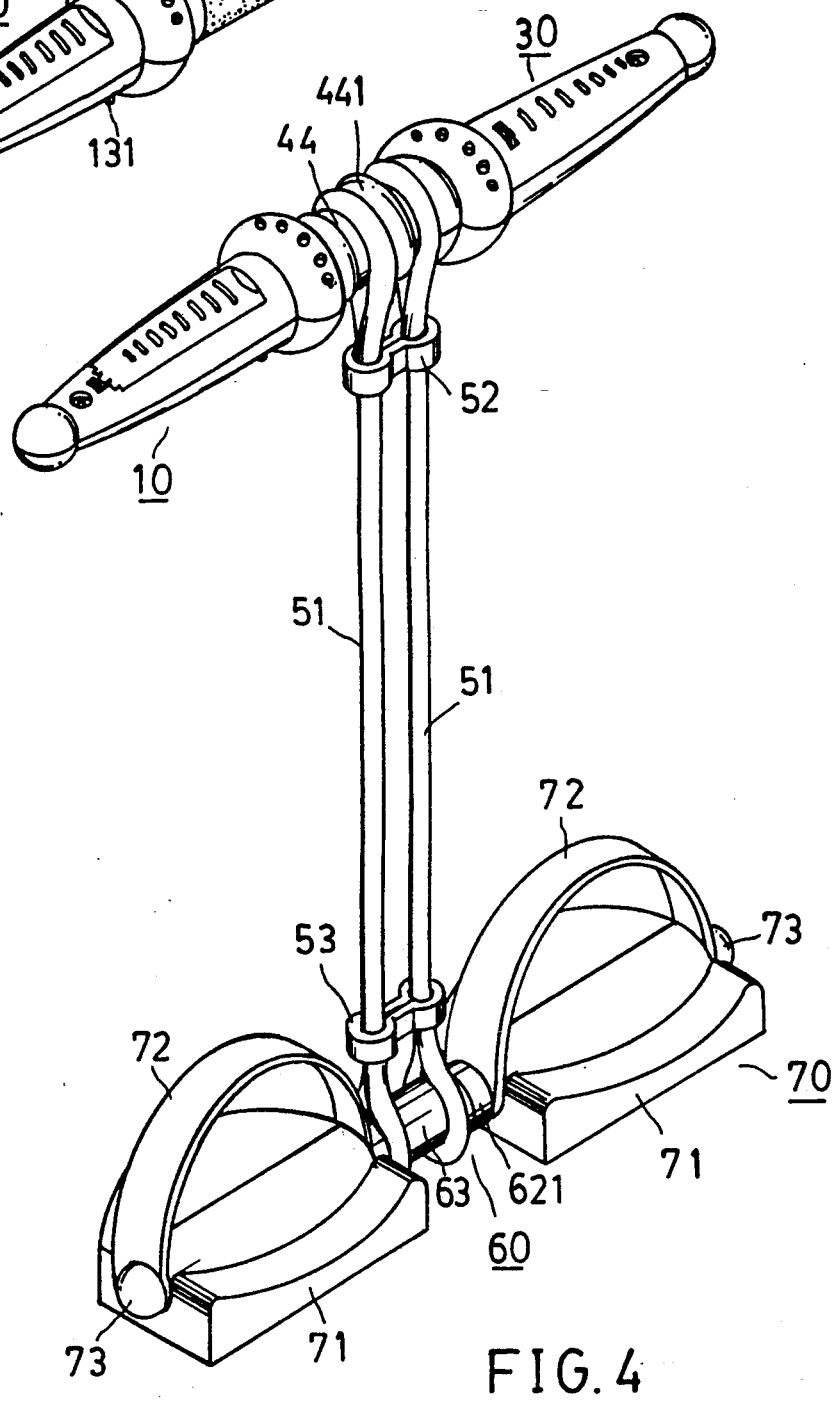
FIG. 4 shows an external three-dimensional view of an assembled leg press machine as shown in FIG. 3.

In using the exercise device as shown in FIG. 4, in conjunction with FIG. 2, hold secrely the handles 10 and 30 of the hand grip with both hands so as to bend the connection rod 41 back and forth to do muscular exercise. The user may also step on the steps 71 and hold the handles 10 and 30 with both hands to pull repeatedly the cane-like elastic bodies 51. As soon as the switch 131 has been turned on, the musical melodies, sports music, or commands programmably stored in the sound-reproducing means are reproduced immediately. As the count switch 322 is truned on, the exercise counts are digitally registered with precision and are visible through the count display apparatus. Such device having dual purposes of being used as sports and recreational equipments should be expected to be well received by people in general and by youngsters in particular.

The embodiments of the present invention described above are to be considered in all respects as merely illustrations of principles of the present invention. Accordingly, the present invention is to be limited only by the scope of the hereinafter appended claims.

What is claim is:

1. An exercise hand grip having sound-reproducing means comprising mainly two handles and one connection rod, one of said handles having a first housing of a hollow construction made of plastic material by means of injection molding, said first housing consisting of a speaker mount with a circular speaker disposed thereon, a sound-reproducing apparatus provided therein with conductive pieces disposed in a battery mount, and a circuit plate in contact with batteries lodged in said battery mount, said circuit plate comprising thereon an integrated circuit storing programmably musical melodies or commands, one of said handles further comprising a second housing in conjunction with said first housing, said second housing being of a hollow construction made of plastic material by means of injection molding and being symmetrical in shape with said first housing, another one of said handles being provided with a third housing and a fourth housing, both being of hollow constructions made of plastic material by means of injection molding, said connection rod being of a bendable spring body coupled pivotally at both ends thereof with said handles.

2. An exercise hand grip having sound-reproducing means according to claim 1 further comprising two rectangular steps having a through hole disposed along the horizontal axis thereof, a fitting rod with both ends thereof being pivotally fastened to said through holes of said rectangular steps, and two elastic bodies with one end thereof being fastened with the connection rod and the other end thereof being fastened with said fitting rod.

3. An exercise hand grip having sound-reproducing means according to claim 1, wherein one of said handles is provided with an exercise count display apparatus.

4. An exercise hand grip having sound-reproducing means according to claim 1, wherein said connection rod may be a rigid sleeve.

* * * * *